US007258580B1

(12) United States Patent
Ho et al.

(10) Patent No.: US 7,258,580 B1
(45) Date of Patent: Aug. 21, 2007

(54) ELECTRICAL ADAPTER ASSEMBLY

(75) Inventors: Lien-Hsun Ho, Taipei (TW); Yi-Chang Chou, Taipei (TW); Pei-Lun Chiang, Taipei (TW)

(73) Assignee: Cyber Power System Inc. (TW)

( * ) Notice: Subject to any disclaimer, the term of this patent is extended or adjusted under 35 U.S.C. 154(b) by 0 days.

(21) Appl. No.: 11/634,243

(22) Filed: Dec. 6, 2006

(51) Int. Cl.
*H01R 24/04* (2006.01)

(52) U.S. Cl. ..... 439/668; 439/188

(58) Field of Classification Search ..... 439/676, 439/700, 668, 170, 824, 188
See application file for complete search history.

(56) References Cited

U.S. PATENT DOCUMENTS 3,865,463 A * 2/1975 Busch ..... 439/668
5,387,136 A * 2/1995 Britton ..... 439/668
5,593,323 A * 1/1997 Dernehl ..... 439/668
5,964,623 A * 10/1999 Maher et al. ..... 439/668
6,354,882 B1 * 3/2002 Lindqvist et al. ..... 439/668
6,478,628 B1 * 11/2002 Ming ..... 439/668
6,612,875 B1 * 9/2003 Liao ..... 439/675

* cited by examiner

*Primary Examiner*—Michael C. Zarroli
(74) *Attorney, Agent, or Firm*—Hershkovitz & Associates; Abe Hershkovitz

(57) ABSTRACT

An electrical adapter assembly has a cable and an adapter. The cable has a distal end having a plug and a proximal end having a connector. The connector comprises a shell having an inner space, a first end and a second end having an output hole allowing the cable to be mounted in the inner space. The second end of the connector has an outer surface, a positive electrode, a negative electrode and a thermal sensor mounted in the inner space of the connector. The adapter connects to the cable and has a circuit board and a socket corresponding to the plug. Because the thermal sensor can sense the temperature in the connector and cut off the current when the temperature is too high, the cable will not be damaged and users will not be in danger.

4 Claims, 5 Drawing Sheets

ELECTRICAL ADAPTER ASSEMBLY

BACKGROUND OF THE INVENTION

1. Field of Invention

The present invention relates to an electrical adapter assembly, and more particularly to an electrical adapter assembly that can detect temperature in a cable to prevent the cable from being overheated to cause damage.

2. Description of the Related Art

Power source for an automobile has a battery and a smoke lighter. In the past, the smoke lighter is set in an automobile for a driver and passengers who are smokers. Recently, the smokers will not smoke in cars for health and safety reasons. The smoke lighter is not used to light cigarettes, but offers electricity to an electrical appliance such as a laptop, a personal digital assistant (PDA), mobile phone or the like.

A conventional adapter assembly has an adapter and a cable.

The adapter can receive input electricity that may have 150 watts (W) or 200 W electric power and has a circuit board and a socket. The socket board is mounted in the adapter to transform the direct current (DC) to alternating current (AC) (770V/220V). The socket has a contact. The contact is mounted in the socket and connects with the circuit board.

The cable connects the adapter with a battery or a smoke lighter and has a distal end and a proximal end. The distal end has a plug. The plug is mounted on the distal end of the cable, detachably plugs into the socket and contact the contact. The proximal end has a connector. The connector is mounted on the proximal end, connects with the power source and may be a smoke lighter connector or have two crocodile clips. When the connector is the smoke lighter connector, the connector connects with the smoke lighter to allow electricity that has electric power only below 150 W to input the cable. When the connector has the two crocodile clips, the crocodile clips clip the battery to allow electricity that has electric power upper to 200 W to be inputted in the cable.

However, if the plug of the cable with the smoke lighter connector plugs into the socket of the adapter that can stand for 200 W electricity, electricity current will overload the cable. Thus, the cable will be overheated to cause damage and even users will be injured.

To overcome the shortcomings, the present invention provides an electrical adapter assembly to mitigate or obviate the aforementioned.

SUMMARY OF THE INVENTION

The primary objective of the present invention is to provide an electrical adapter assembly that can detect temperature in a cable to prevent the cable from being overheated and causing damage.

To achieve the objective, the electrical adapter assembly has a cable and an adapter. The cable has a distal end and a proximal end. The distal end has a plug. The proximal end has a connector. The connector has a shell having an inner space, a first end and a second end. The second end of the connector has an output hole. The output hole allows the cable to be mounted in the inner space. The connector further has an outer surface, a positive electrode, a negative electrode and a thermal sensor. The thermal sensor is mounted in the inner space of the connector. The adapter connects to the cable and has a circuit board and a socket. The circuit board is mounted in the adapter. The socket is mounted on the adapter, allows the plug to plug into the socket and has at least one contact. The contact connects to the circuit board. Because the thermal sensor can sense the temperature in the connector and cut off the current when the temperature is too high, the cable will not be damaged and users will not be in danger.

Other objectives, advantages and novel features of the invention will become more apparent from the following detailed description when taken in conjunction with the accompanying drawings.

DETAILED DESCRIPTION OF THE INVENTION

Figure 1:
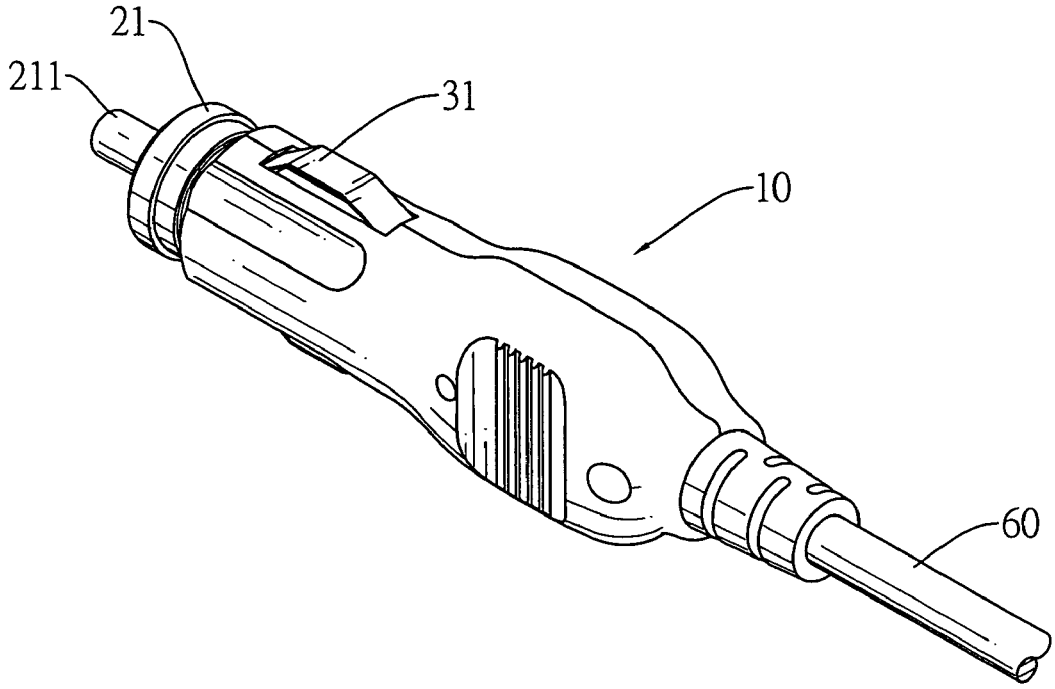
FIG. 1 is a perspective view of a connector of an electrical adapter assembly in accordance with the present invention.

With reference to FIGS. 1 to 4, an electrical adapter assembly in accordance with the present invention has a cable (60) and an adapter (70).

The cable (60) connects to a power source such as a battery or a smoke lighter and has a distal end and a proximal end.

The distal end has a plug (61). The plug (61) is mounted on the distal end of the cable (60) and has at least one through hole (611) defined in the plug (61). The distal end may have five through holes (611). The through holes (611) are arranged abreast in the plug (61).

The proximal end has a connector (10). The connector (10) has a shell mounted on the proximal end, connecting to the power source, comprising two shell halves and having an inner space, a first end, a second end, an outer surface, a positive electrode, a negative electrode and a thermal sensor.

The first end has an input hole defined through the first end and communicating with the inner space.

The second end has an output hole (12). The output hole (12) is defined through the second end, communicates with the inner space and allows the cable (60) to be mounted in the inner space.

The outer surface has two opposite recesses (13). Each recess (13) is formed in the outer surface and has a proximal end, a distal end, a slot (14) and an opening (15). The proximal end of the recess (13) corresponds to and is near the input hole (11). The distal end of the recess (13) corresponds to the output hole (12). The slot (14) is mounted in the proximal end. The opening (15) is formed through the distal end and communicates with the inner space.

The positive electrode has a terminal (21) and a positive wire (22). The terminal (21) covers the first end of the shell and has an electrically conductive protrusion (211). The protrusion (211) is mounted through and extends out of the input hole (11) to contact with the power source. The positive wire (22) connects the protrusion (211) to the cable (60).

The negative electrode combines the positive electrode to form a circuit to allow current to pass. The negative electrode comprises a resilient tab (31) and a negative wire (32). The resilient tab (31) is C-shaped, is electrically conductive, is mounted in the inner space, extends out of the shell and has two ends. Each end extends in the recess (13) of the outer surface from the opening (15) and is fastened in the slot (14) of the recess (13) to contact the power source. The negative wire (32) connects the resilient tab (31) with the cable (60).

The thermal sensor is mounted in the inner space of the connector (10) to sense temperature in the connector (10). A first embodiment of the electrical adapter assembly has the thermal sensor being a bimetallic strip assembly. A second embodiment of the electrical adapter assembly has the thermal sensor being a thermistor.

Figure 2:
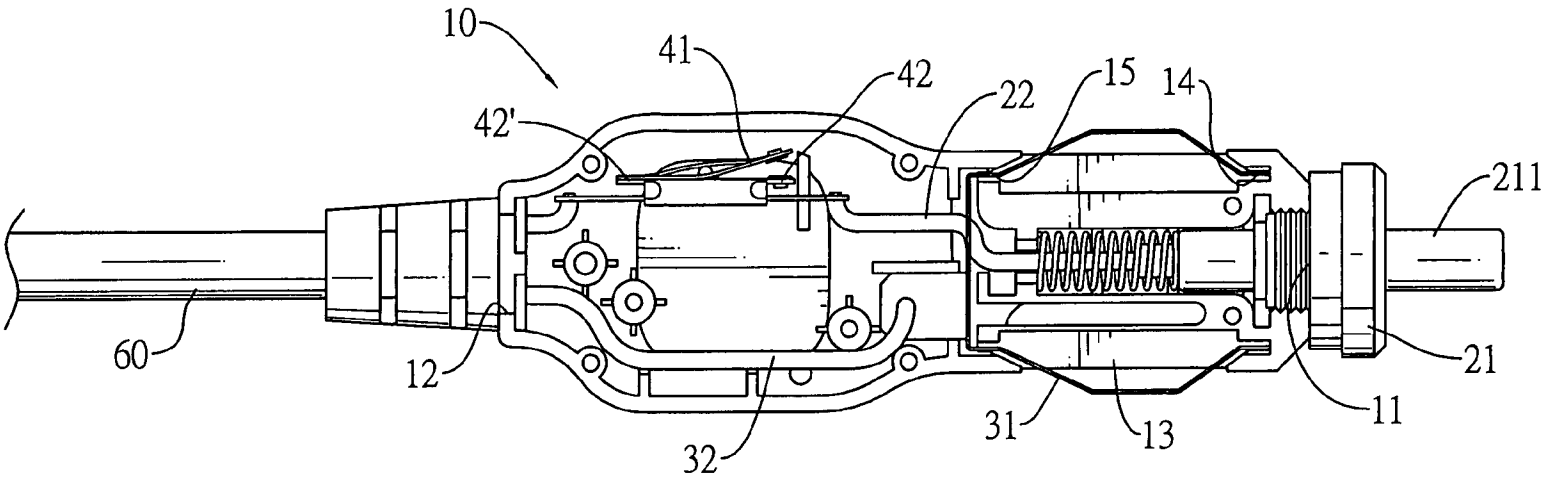
FIG. 2 is a side view of the connector of a first embodiment of the electrical adapter assembly in FIG. 1 with one shell half detached.

With reference to FIG. 2, the bimetallic strip assembly has a first bracket (42') and a second bracket (42) and a bimetallic strip (41). Each of the first and second brackets (42) is electrically conductive, connects electrically to the positive wire (22). The bimetallic strip (41) comprises two metal tabs that have different thermal expansion coefficients and has a proximal end and a distal end. The proximal end of the bimetallic strip (41) securely connects electrically with the first bracket (42') and the distal end selectively contacts electrically the second bracket (42) When temperature in the connector (10) is normal, the distal end of the bimetallic strip (41) contacts the second bracket (42) to allow electricity to pass the positive wire (22). When temperature in the connector (10) is too high, the distal end of the bimetallic strip (41) separates from the second bracket (42), electricity can not pass through the positive wire (22) and the electrical adapter assembly can not work.

Figure 3:
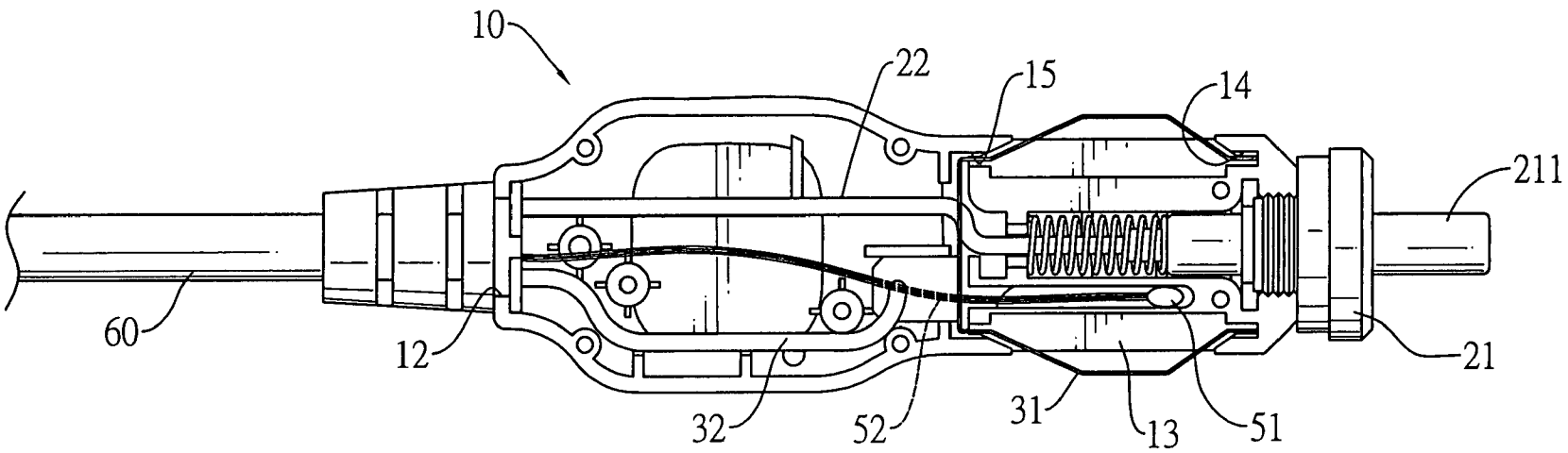
FIG. 3 is a side view of the connector of a second embodiment of the electrical adapter assembly in FIG. 1 with one shell half detached.

With reference to FIG. 3 the thermistor is mounted in the inner space of the connector (10) and comprises a resistor (51) and a sensor wire (52). The resistor (51) can sense heat and generate a signal when the connector (20) overheats. The sensor wire (52) connects the resistor (51) to the cable (60) and can transmit the signal from the resistor (51) to the cable (60).

Figure 4:
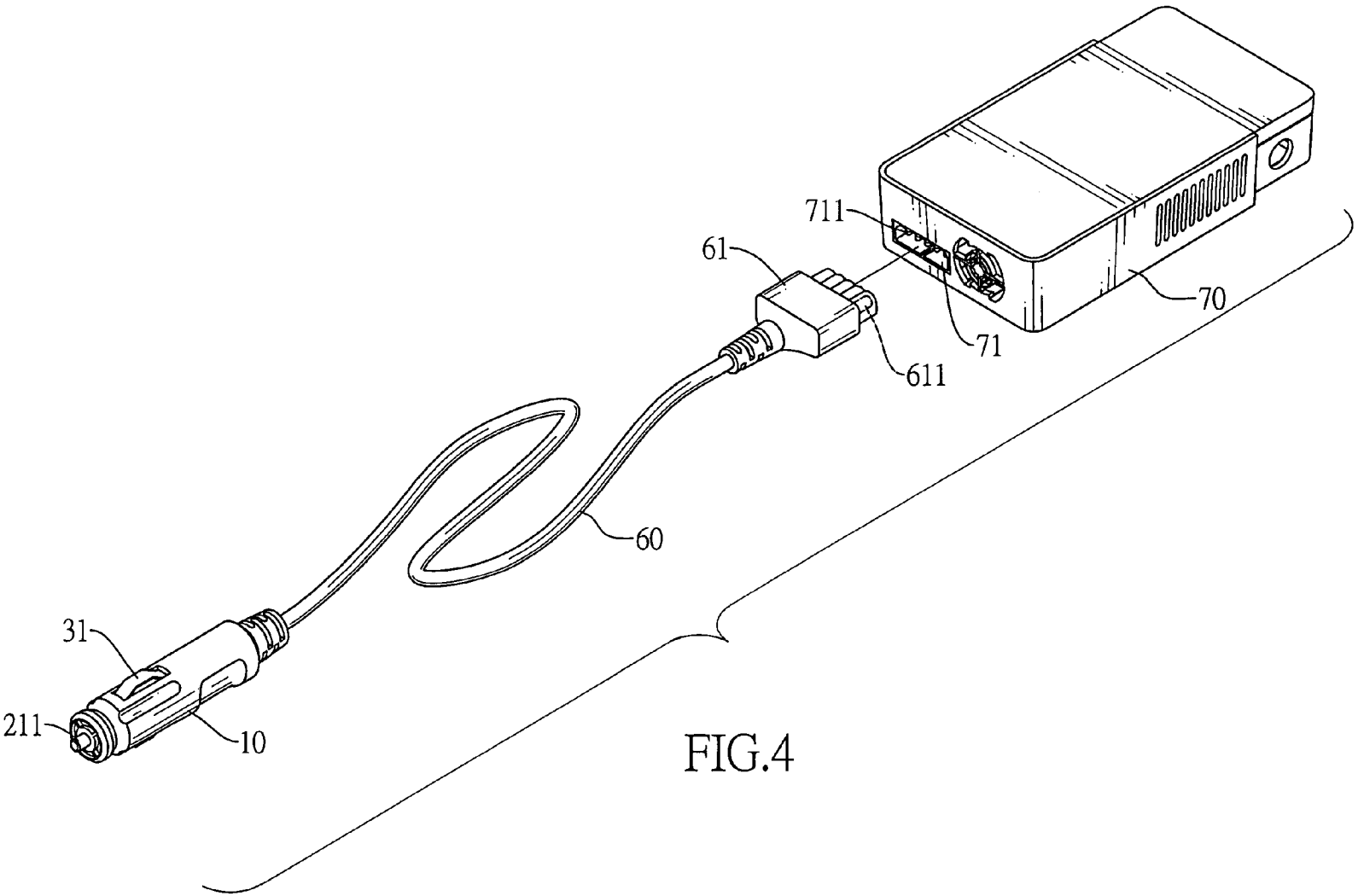
FIG. 4 is a perspective view of an electrical adapter assembly in accordance with the present invention.
Figure 5:
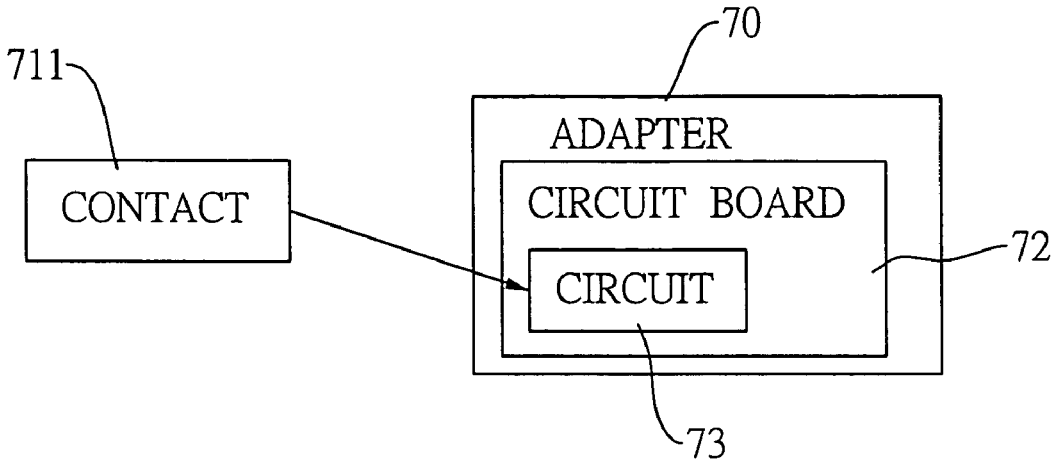
FIG. 5 is a diagram of a contact transmitting an overheated signal to a circuit of a circuit board of an adapter of the electrical adapter assembly in FIG. 4.

With further reference to FIGS. 4 and 5, the adapter (70) connects to the power source via the cable (60) and has a circuit board (72) and a socket (71). The circuit board (72) is mounted in the adapter (70) and may have a circuit (73) when the thermal sensor is a thermistor. The circuit (73) is mounted on the circuit board (72) and has a switch deactivating the circuit to stop the adapter (70) from working and cut off the current when the circuit board (72) receives a signal from the thermistor because the connector (20) is overheated. The socket (71) is mounted on the adapter (70), allows the plug to plug into the socket (71), connects to the circuit board (72) and has at least one contact (711). The contact (711) is mounted in the socket (71) and connects to the circuit board (72). A preferred embodiment of the socket (71) may have five contacts (711). One of the contacts (711) is a detector connecting to the circuit (73) to transmit the signal to the circuit (73).

Because the thermal sensor can sense the temperature in the connector (10) and cut off the current when the temperature is too high, the cable (60) will not be damaged and users will not be in danger.

Even though numerous characteristics and advantages of the present invention have been set forth in the foregoing description, together with details of the structure and function of the invention, the disclosure is illustrative only. Changes may be made in detail, especially in matters of shape, size and arrangement of parts within the principles of the invention to the full extent indicated by the broad general meaning of the terms in which the appended claims are expressed.

What is claimed is:

1. An electrical adapter assembly comprising:

a cable having a distal end having a plug mounted on the distal end of the cable and having at least one through hole defined in the plug;

a proximal end having a connector having a shell mounted on the proximal end and the shell having an inner space;

a first end having an input hole defined through the first end and communicating with the inner space;

a second end having an output hole defined through the second end and communicating with the inner space to allow the cable to be mounted in the inner space;

an outer surface;

a positive electrode having a terminal and a positive wire, wherein the terminal covers the first end and has an electrically conductive protrusion mounted through and extending out of the input hole; and the positive wire connects the protrusion and the cable;

a negative electrode comprising a resilient tab and a negative wire, wherein the resilient tab is electrically conductive, is mounted in the inner space and extends out of the shell; and the negative wire connects the resilient tab to the cable;

a thermal sensor mounted in the inner space of the connector;

an adapter connecting to the cable and having a circuit board mounted in the adapter; and a socket mounted on the adapter to allow the plug to plug into the socket and having at least one contact mounted in the socket and connecting to the circuit board.

2. The electrical adapter assembly as claimed in claim 1, wherein the thermal sensor is a bimetallic strip assembly having a first bracket and a second bracket, and each of the first and second brackets being electrically conductive and connecting to the positive wire; and a bimetallic strip having a proximal end securely connecting to the first bracket; and a distal end selectively contacting the second bracket.

3. The electrical adapter assembly as claimed in claim 1, wherein the distal end of the plug has five through holes arranged abreast in the plug;

the thermal sensor is a thermistor comprising a resistor mounted in the inner space of the connector; and a sensor wire connecting the resistor to the cable;

the circuit board has a circuit mounted on the circuit board; and the socket has five contacts mounted in the plug and connecting to the circuit board, and one of the contacts is a detector connecting to the circuit.

4. The electrical adapter assembly as claimed in claim 1, wherein the outer surface of the first end of the connector has two opposite recesses, and each recess is formed in the outer surface and has a proximal end being near the input hole;

a distal end being near the output hole;

a slot mounted in the first end of the shell; and an opening formed through the second end of the shell and communicating with the inner space;

the resilient tab of the negative electrode has two ends; and each end extending into the recess of the outer surface from the opening and fastened in the slot of the recess.

* * * * *